US005507156A

United States Patent [19]

Redmon

[11] Patent Number: 5,507,156

[45] Date of Patent: Apr. 16, 1996

[54] DEVICE FOR COOLING LIQUIDS IN A SPORT BOTTLE

[75] Inventor: Christopher L. Redmon, Houston, Tex.

[73] Assignee: Cooler Concepts, Inc., Houston, Tex.

[21] Appl. No.: 416,297

[22] Filed: Apr. 4, 1995

[51] Int. Cl.[6] ..... B67D 5/62

[52] U.S. Cl. ..... 62/400; 62/457.3; 62/530; 220/705

[58] Field of Search ..... 62/371, 372, 400, 62/457.1, 457.2, 457.3, 529, 530; 220/705, 708

[56] References Cited

U.S. PATENT DOCUMENTS 5,129,238 7/1992 Schwartz et al. ..... 62/457.3

5,288,019 2/1994 Gorochow ..... 62/457.3

*Primary Examiner*—John M. Sollecito

*Attorney, Agent, or Firm*—Keith Lutsch

[57] ABSTRACT

A cooling device which utilizes an ice substitute in a shaped container which can be inserted into a sport bottle and retained in place by the straw so that the cooling device remains at the bottom of the sport bottle. The cooling device contains openings or slots at the bottom to allow the fluid to be drawn through the openings after it has flowed past the cooling device. The cooling device contains a hollow center through which the straw is placed, with retaining nibs or protrusions holding the cooling device in place and retaining it with respect to the straw. The device can be available in different sizes to fit a number of sport bottles and straws.

18 Claims, 1 Drawing Sheet

DEVICE FOR COOLING LIQUIDS IN A SPORT BOTTLE

BACKGROUND OF THE INVENTION

1. Field of the Invention

The invention relates to packaged ice substitutes used for cooling liquids in containers.

2. Description of the Related Art

Recently sport bottles have become very popular. Sport bottles are those containers which generally have a screw-on lid, are relatively tall and easy to hold and have a straw protruding through the top which is received in the body of the container to allow removal of liquid. They have become quite popular given the increased exercise activity of individuals. They are quite convenient because they do not leak and can be readily carried or placed without fear of spilling or loosing fluid. Further, they have been quite popular as a method of advertising products. To use the sport bottle, one simply places the desired liquid, such as water, fruit juice, soft drink or exercise drink, in the sport bottle, closes the lid and inserts the straw, if it has been removed from the lid. Thereafter, whenever it is desired to receive some liquid, merely opening a cap on the straw allows access to the liquid through the straw.

However, there are certain problems that have developed in the use of sport bottles. As noted above, the sport bottles are typically being utilized in an outdoor environment which makes it very difficult to keep the contents cool. In most cases the bottle will just sit out in the sun or the hot air and rapidly lose any of the chill of the liquid, with the result that you then have a warm liquid. This is highly undesirable as cool liquids are significantly more refreshing. Attempts have been made to provide additional layers of insulation, typically an expanded foam, over the sport bottle to provide insulation to reduce the heating effects. However, this is only partially successful.

It is possible to utilize ice in the sport bottle, but this has several additional problems. First, ice floats, so that with the straw intake being at the bottom of the bottle and the ice being at the top, the liquid is not particularly chilled. Further, if the liquid is anything other than water it is diluted by the ice. This creates a dilution effect which is also not necessarily desirable. Further, in many cases because of the shape of the available ice cubes it is not possible to place the ice in the sport bottle and yet have the straw properly centered. Therefore, there is a major problem in keeping the contents of the sport bottle cool using the known techniques.

SUMMARY OF THE PRESENT INVENTION

A device according to the present invention utilizes an ice substitute in a shaped container which can be inserted into the sport bottle and retained in place by the straw so that the device remains at the bottom of the sport bottle. The cooling device contains openings or slots at the bottom to allow the fluid to be drawn through the openings after it has flowed past the cooling device. In this way, the liquid is always cooled prior to being obtained into the straw. The cooling device contains a hollow center through which the straw is placed, with retaining nibs or protrusions holding the cooling device in place and retaining it with respect to the straw. Because the cooling device is a sealed unit, there is no dilution problem. Because the cooling device is retained at the bottom of the sport bottle and the liquid must flow past the cooling device prior to entering the straw, the liquid is always properly cooled to a maximum effect.

The device can be available in different sizes to fit a number of sport bottles and straws. The cooling device is simply kept in the freezer prior to use and then upon use is retrieved from the freezer and placed in the sport bottle, which is then filled with the liquid, which then has the straw inserted and the lid placed. Thereafter, the cooling device will gradually cool the fluids and retain the cooling capabilities for a long period, particularly as fluid is displaced up the straw.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
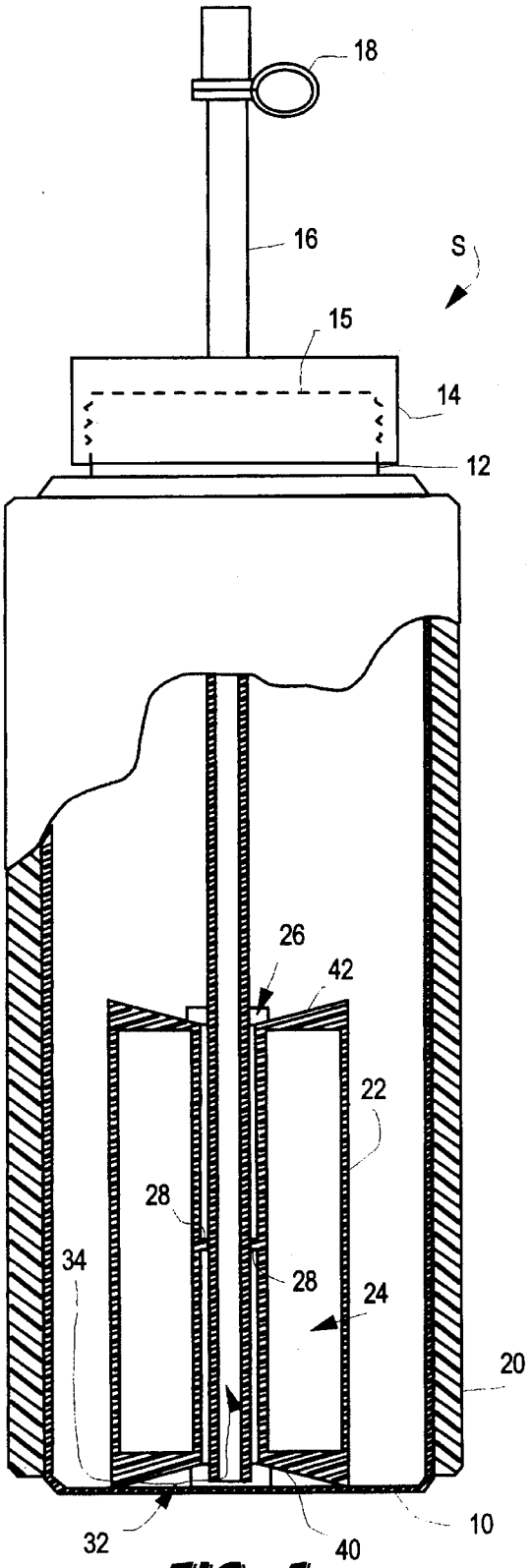
FIG. 1 is a view in partial cross section of a sport bottle including a cooling device according to the present invention.

Referring now to FIG. 1, a sport bottle S is generally shown. The sport bottle S is a basic bottle or container 10 having a top surface 12 designed to mateably receive a lid 14. A hole (not shown) is present in the center of the lid 14 to allow a straw 16 to be inserted into the sport bottle S. Preferably, the straw 16 extends the length of the sport bottle S and protrudes a desirable distance above the lid 14 to allow easy use by the user. The straw 16 preferably includes a closable cap 18 to allow the straw 16 to be closed so that fluid is not lost. Preferably the sport bottle S also contains an outer insulating layer 20 over the bottle 10 to provide insulative effects and reduce the warming of any fluids contained in the sport bottle S. A cooling device 22 is positioned in the sport bottle S at the bottom of the container 10.

The cooling device 22 is generally cylindrical in shape and hollow, containing a chamber 24. The chamber 24 is preferably toroidal, with the cooling device 22 having a central cylindrical opening 26 in which the straw 16 is received. The chamber 24 contains a readily available ice substitute such as a methyl-cellulose product such as Methocel® from Dow Chemical Co. Other suitable ice substitutes are readily known to those skilled in the art and can be used in the cooling device 22.

Figure 3:
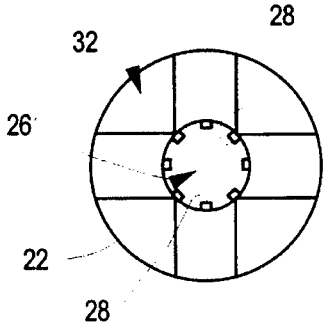
FIG. 3 is a top view of the cooling device according to the present invention.
Figure 4:
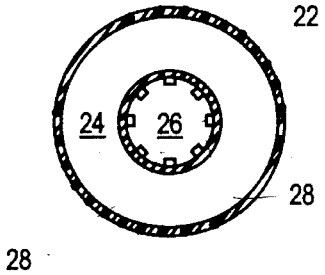
FIG. 4 is a cross-sectional view of the cooling device of FIG. 2.

The straw 16 is placed in the cylindrical opening 26 of the cooling device 22. A series of protruding tabs 28 are located preferably intermediate the ends of the cooling device 22 and extend radially inwardly in the opening 26 to capture the straw 16. In this manner, the straw 16 is positively retained and the cooling device 22 is retained at the bottom of the sport bottle S. As can be seen in FIGS. 3 and 4, preferably there are 8 tabs equally aligned around the circumference of the opening 26, through a different number could be used.

Figure 2:
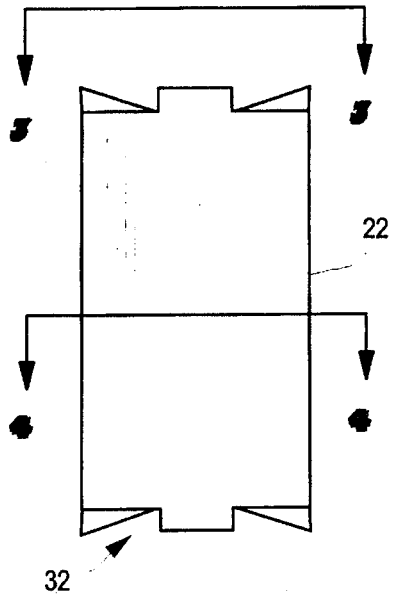
FIG. 2 is a side view of the cooling device according to the present invention.

It is further noted that the ends 40 and 42 of the cooling device 22 surrounding the chamber 24 are angled in an inward direction. In this manner the length of the cooling device 22 is greater at the outside surface then at the inside surface. As seen in FIGS. 2 and 3, this creates a recessed area 32 through which fluid must flow as is indicated by the path 34 to enter into the straw. In this manner fluid flow is in a downwardly direction in the sport bottle S, passing over the cooling device 22, and then upwardly into the straw 16. This ensures the maximum cooling effect occurs for all fluid that is being enjoyed, in contrast to the prior art case where the ice floats at the top and the fluid is received from the bottom without any cooling effect.

To utilize the cooling device 22, a properly sized unit for the particular sport bottle S in use is obtained. For example, the outer diameter of the cooling device 22 must be less than the inner diameter of the opening 15 in the top of the sport bottles to allow the cooling device 22 to be readily passed through. In addition, the diameter of the opening 26 less the protrusion by the tabs 28 must be slightly less than the diameter of the straw 16 to properly retain the straw 16. Thus it is envisioned that a number of different sizes and styles of the cooling device 22 will be developed for varying sizes of sport bottles S and straws.

Preferably the cooling device 22 is retained in a freezer until use is desired. The cooling device 22 is obtained from the freezer and placed in the sport bottle S through the opening 15, at which time the desired liquid is then placed in the sport bottle S to the desired level. The lid 14 is then placed on the sport bottles and the straw inserted into the lid 14 and the cooling device 22. The sport bottle S is then ready for use and the cooling effect will begin occurring.

Preferably all of the materials are made out of various plastic materials to allow ease of manufacturing except that of course the ice substitute located in the chamber 24 is a conventional ice substitutes as discussed above. Plastics are preferred for the container 10, bottle S, the straw 16, the lid 14 and the cooling device 22 because of cost of manufacture. It is understood that various other materials could be utilized. It is also understood that the various dimensions of the cooling device 22 could be adapted to be of a desired height or width for the proper desired cooling effect and to adapt properly with the various sizes and shapes of sport bottles S. Additionally, the cooling device 22 can be stacked in a given sport bottle S to allow greater cooling. It is understood that the general cylindrical shape is preferred and will cooperate with the greatest majority of the sport bottles S, but other general shapes could also be used.

In an alternative embodiment, the cooling device 22 could include an opening into the chamber 24, which is sealed with a proper cap. The chamber 24 is then fillable with water or other liquid, instead of being permanently sealed as in the preferred embodiment.

Therefore a cooling device according to the present invention allows cooling of liquids in sport bottles without dilution of the liquid, with maximal cooling effect and can be readily inserted to cooperate with the sport bottle and the straw. With this improvement the user can more readily enjoy the liquids contained in the sport bottle and get maximum benefit out of the exercise or other leisure activity.

Having described the invention above, various modifications of the techniques, procedures, material and equipment will be apparent to those in the art. It is intended that all such variations within the scope and spirit of the appended claims be embraced thereby.

I claim:

1. A cooling device for use with a bottle having top opening of a predetermined size, a lid covering the top opening and a straw protruding through the lid to approximately the bottom of the bottle, the cooling device comprising:

a closed container, the container having a closed outer surface sized to fit through the top opening in the bottle, having top and bottom surfaces and having an opening inside the periphery of the outer surface, the opening extending from the top to the bottom of the container to form an inner wall, the container thereby having a closed chamber between said inner wall and said periphery, the container further having a plurality of inwardly projecting tabs located on said inner wall to develop a tab opening size, the size of the opening being greater than the size of the straw and the tab opening size being less than the size of the straw, wherein said closed container is retained in position along the straw by said tabs; and a freezable fluid located in said closed chamber.

2. The cooling device of claim 1, wherein the closed container is generally cylindrical.

3. The cooling device of claim 2, wherein said opening is cylindrical.

4. The cooling device of claim 3, wherein said tabs are uniformly spaced around the circumference of said opening.

5. The cooling device of claim 1, wherein said tabs are placed approximately equidistant from said top and bottom of said container.

6. The cooling device of claim 1, wherein said outer surface has a predetermined height, said opening has a predetermined height less than that of said outer surface and said opening is located substantially within the height and above the bottom of said outer surface, such that said bottom surface is angled inwardly from said outer surface to said opening.

7. The cooling device of claim 6, wherein said opening is located substantially centered along the height of said outer surface, such that said top surface is also angled inwardly.

8. The cooling device of claim 6, wherein said bottom surface includes a plurality of recessed areas allowing liquid flow from around said outer surface through said plurality of recessed areas to the straw when said closed container is positioned adjacent the bottom of the bottle.

9. The cooling device of claim 1, wherein said chamber is permanently sealed.

10. A drinking bottle for holding liquids comprising:

a bottle having a top opening of a predetermined size;

a lid covering said top opening;

a straw protruding through said lid to approximately the bottom of said bottle, and a cooling device located around and at the bottom end of said straw, said cooling device including:

a closed container, the container having a closed outer surface sized to fit through the top opening in the bottle, having top and bottom surfaces and having an opening inside the periphery of the outer surface, the opening extending from the top to the bottom of the container to form an inner wall, the container thereby having a closed chamber between said inner wall and said periphery, the container further having a plurality of inwardly projecting tabs located on said inner wall to develop a tab opening size, the size of the opening being greater than the size of the straw and the tab opening size being less than the size of the straw, wherein said closed container is retained in position along the straw by said tabs; and a freezable fluid located in said closed chamber.

11. The drinking bottle of claim 10, wherein the closed container is generally cylindrical.

12. The drinking bottle of claim 11, wherein said opening is cylindrical.

13. The drinking bottle of claim 12, wherein said tabs are uniformly spaced around the circumference of said opening.

14. The drinking bottle of claim 10, wherein said tabs are placed approximately equidistant from said top and bottom of said container.

15. The drinking bottle of claim 10, wherein said outer surface has a predetermined height, said opening has a predetermined height less than that of said outer surface and said opening is located substantially within the height and above the bottom of said outer surface, such that said bottom surface is angled inwardly from said outer surface to said opening.

16. The drinking bottle of claim 15, wherein said opening is located substantially centered along the height of said outer surface, such that said top surface is also angled inwardly.

17. The drinking bottle of claim 15, wherein said bottom surface includes a plurality of recessed areas allowing liquid flow from around said outer surface through said plurality of recessed areas to the straw when said closed container is positioned adjacent the bottom of the bottle.

18. The drinking bottle of claim 10, wherein said chamber is permanently sealed.

* * * * *